US009835169B2

(12) United States Patent
Sarri et al.

(10) Patent No.: US 9,835,169 B2
(45) Date of Patent: Dec. 5, 2017

(54) ACTUATOR SEALING SYSTEM AND METHOD

(76) Inventors: Franco Sarri, Florence (IT); Giuseppe Iurisci, Florence (IT); Marco Pelella, Florence (IT)

( * ) Notice: Subject to any disclaimer, the term of this patent is extended or adjusted under 35 U.S.C. 154(b) by 840 days.

(21) Appl. No.: 14/343,312

(22) PCT Filed: Sep. 6, 2012

(86) PCT No.: PCT/EP2012/067447

§ 371 (c)(1),
(2), (4) Date: Mar. 6, 2014

(87) PCT Pub. No.: WO2013/034656

PCT Pub. Date: Mar. 14, 2013

(65) Prior Publication Data

US 2014/0234083 A1 Aug. 21, 2014

(30) Foreign Application Priority Data

Sep. 9, 2011 (IT) ..... CO2011A0037

(51) Int. Cl.
*F04D 29/46* (2006.01)
*F01D 17/16* (2006.01)
(Continued)

(52) U.S. Cl.
CPC ..... *F04D 29/462* (2013.01); *F01D 17/165* (2013.01); *F04D 29/083* (2013.01);
(Continued)

(58) Field of Classification Search
CPC .... F04D 27/0246; F04D 29/46; F04D 29/462; F04D 29/083; F04D 29/5853; F01D 17/165; F05D 2260/72; F05D 2260/231
See application file for complete search history.

(56) References Cited

U.S. PATENT DOCUMENTS 3,961,798 A 6/1976 Damratowski et al.
4,198,829 A * 4/1980 Carle ..... F04B 37/08 417/901

(Continued)

FOREIGN PATENT DOCUMENTS

CN 1058449 A 2/1992
CN 1746506 A 3/2006

(Continued)

OTHER PUBLICATIONS

Straszewski et al (Mossmorran—a new peak in mechanical sealing—Jan. 1985).*

(Continued)

*Primary Examiner* — Gregory Anderson
*Assistant Examiner* — Juan G Flores
(74) *Attorney, Agent, or Firm* — GE Global Patent Operation

(57) ABSTRACT

Actuator devices useable to change orientation of one or more vanes, including an actuator rod and an actuator device body configured to allow the actuator rod to move along the axis inside the actuator device body, and having an inlet flange configured to allow a third fluid to enter a space between the actuator device body and the actuator rod, and an outlet flange configured to allow the third fluid to exit the actuator device body. Besides providing a fluid seal between the first fluid and the second fluid, the third fluid may also heat the actuator rod thereby preventing ice formation.

18 Claims, 8 Drawing Sheets

(51) Int. Cl.
*F04D 29/08* (2006.01)
*F04D 29/40* (2006.01)
*F04D 29/42* (2006.01)

(52) U.S. Cl.
CPC ..... *F04D 29/403* (2013.01); *F04D 29/4213* (2013.01); *F05D 2240/55* (2013.01); *F05D 2250/51* (2013.01)

(56) References Cited

U.S. PATENT DOCUMENTS

| | | | | |
|---|---|---|---|---|
| 4,720,237 | A | 1/1988 | Weiner et al. | |
| 5,054,996 | A | 10/1991 | Carreno | |
| 5,067,563 | A | 11/1991 | Rode | |
| 5,851,104 | A | 12/1998 | Dakin et al. | |
| 6,129,511 | A | 10/2000 | Salvage et al. | |
| 6,269,642 | B1 | 8/2001 | Arnold | |
| 6,325,382 | B1 | 12/2001 | Iwamoto et al. | |
| 9,243,648 | B2 * | 1/2016 | Clemons | F01D 17/162 |
| 2003/0006561 | A1 | 1/2003 | Takahashi et al. | |
| 2007/0166149 | A1 | 7/2007 | Tacconelli | |
| 2008/0050220 | A1 | 2/2008 | Merry et al. | |
| 2010/0172745 | A1 * | 7/2010 | Hodder | F04D 29/462 415/163 |
| 2012/0121403 | A1 | 5/2012 | Clemons | |

FOREIGN PATENT DOCUMENTS

| | | | |
|---|---|---|---|
| GB | 1190805 | A1 | 5/1970 |
| JP | S49034211 | A | 3/1974 |
| JP | S52044364 | A | 4/1977 |
| JP | S5765495 | A | 4/1982 |
| JP | S62210299 | A | 9/1987 |
| JP | 2000088114 | A | 3/2000 |
| JP | 2002508467 | A | 3/2002 |
| JP | 2003004147 | A | 1/2003 |
| JP | 2003193852 | A | 7/2003 |
| RU | 994839 | A1 | 2/1983 |
| SU | 209933 | A1 | 1/1968 |
| WO | 2005088100 | A2 | 9/2005 |
| WO | 2011011338 | A1 | 1/2011 |

OTHER PUBLICATIONS

PCT Search Report from corresponding PCT International Application No. PCT/EP12/067447, dated Jan. 15, 2013.

Written Opinion from corresponding PCT International Application No. PCT/EP12/067447, dated Jan. 15, 2013.

Straszewski, "Mossmorran—a new peak in mechanical sealing", World Pumps, Elseview, Oxford, GB, Jan. 1, 1985, pp. 18-19.

Pludridge, "The Development of More Tolerant Mechanical Seals", Shaft Sealing in Centrifugal Pumps, London, Feb. 12, 1992, Proceedings of the Seminar on Shaft Sealing in Centrifugal Pumps, pp. 9-22.

M. Hensges, "Simulation and Optimization of an Adjustable Inlet Guide Vane for Industrial Turbo Compressors" from the Proceedings of ASME Turbo Expo 2008: Power for Land, Sea and Air, pp. 1-10, Jun. 9-13, 2008.

Unofficial English Translation of Chinese Office Action and Search Report issued in connection with corresponding CN Application No. 201280043619.X dated Jan. 12, 2015.

Unofficial English translation of Office Action and Search Report issued in connection with Corresponding JP Application No. 2014528978 dated Jun. 21, 2016.

Unofficial English translation of Office Action and Search Report issued in connection with corresponding RU Application No. 2014107345 dated Jul. 12, 2016.

* cited by examiner (Background Art) 100

ACTUATOR SEALING SYSTEM AND METHOD

BACKGROUND OF THE INVENTION

Embodiments of the subject matter disclosed herein generally relate to methods and systems and, more particularly, to mechanisms and techniques for sealing an actuator rod in a variable inlet vanes system.

During the past years, the importance of compressors in various industries has increased. The compressors are used in engines, turbines, power generation, cryogenic applications, oil and gas processing, etc. Therefore, various mechanisms and techniques related to compressors are often subject to research for improving the efficiency of this turbomachine and solving problems related to specific situations.

Actuation systems are used in various equipments, such as, compressors, pumps and expanders, to apply a force in order to modify a current state of the equipment. For example, an actuation system may operate adjustable inlet guide vanes (IVG) used in compressor applications to adjust an angle of incidence of inlet air into a compressor rotor and to control an amount of inlet air such as to ensure proper surge and to maximize efficiency.

An example of an adjustable IGV system 100 is shown in FIG. 1, which is reproduced from M. Hensges, Simulation and Optimization of an Adjustable Inlet Guide Vane for Industrial Turbo Compressors from the Proceedings of ASME Turbo Expo 2008: Power for Land, Sea and Air (Jun. 9-13, 2008), the entirety of which is hereby incorporated by reference. The adjustable IGV system 100 includes an actuator lever 102 directly connected to a first vane 104. The first vane 104 is connected via a drive arm 106 to a driving ring 108. The first vane 104 is rotatably attached to a guide vane carrier 110. A plurality of other vanes 112 are rotatably attached to the guide vane carrier 110. The plurality of vanes 112 are actuated by a plurality of linkages 114 that are connected to the driving ring 108. Thus, when the actuator lever 102 is rotated, it determines a rotation of the first vane 104 but also a displacement of the driving ring 108, which results in a movement of the plurality of linkages 114 and a rotation of the plurality of vanes 112.

FIG. 2 illustrates a manner of operating the adjustable IGV system (here 116 is a guide vane carrier). At a contact point 118, an actuation force F applied from an actuation bar 120 is transferred to the driving ring 108. The actuation force transmitted via the actuator rod 120 is generated by an actuation device 130. The actuation device 130 is controlled and/or monitored at least in part by control electronics 140 that is located inside the actuation device.

Given the potentially damaging environment in which the adjustable IGV system 100 may operate (for example, when used in a natural gas installation), the control electronics 140 is isolated from this environment. Conventionally, this separation of the control electronics 140 from the environment is achieved using mechanical seals, for example, a dynamic seal energized by springs closing a space between the body of the actuation device 130 and the actuator rod 120.

It has been observed that the mechanical seals do not operate satisfactory. Moreover, sometimes the gas in the environment (i.e., outside the actuation device) has low (cryogenic) temperature and, therefore, the chilled actuator rod 120, which extends inside the body of the actuator device 130 and is a good heat conductor, may determine ice formation (by condensation of the humidity inside the case). The ice may block the actuators bar's movement.

Further, if the force is generated hydraulically, different pressures inside and outside the actuation device 130 may create further problems (e.g., imbalances and forces) and inefficiencies (e.g., a direction of the force may be altered), when the sealing is not effective.

Accordingly, it would be desirable to provide systems and methods that avoid the afore-described problems and drawbacks.

BRIEF SUMMARY OF THE INVENTION

According to various embodiments, separating a first fluid at one end of an actuator rod and a second fluid at an opposite end of the actuator rod is achieved using at least one fluid flow.

According to one exemplary embodiment, an actuator device useable to change orientation of one or more vanes includes an actuator rod and an actuator device body. The actuator rod is configured to transfer a force along an axis thereof, and having a first end in a first fluid and a second end in a second fluid, the second end being opposite to the first end along the axis. The actuator device body is configured to allow the actuator rod to move along the axis inside the actuator device body, and having has a first inlet flange configured to allow a third fluid to enter a space between the actuator device body and the actuator rod, and a first outlet flange configured to allow the third fluid to exit the actuator device body. The third fluid has a pressure larger than a pressure of the first fluid, and the first outlet flange is closer to the first end of the actuator rod than the first inlet flange.

According to another exemplary embodiment, a compressor has one or more vanes configured to determine at least one of a direction and an amount of a first fluid passing through the compressor, and an actuator device configured to apply a force to the one or more vanes. The actuator device includes an actuator rod and an actuator device body. The actuator rod is configured to transfer a force along an axis thereof, and having a first end in a first fluid and a second end in a second fluid, the second end being opposite to the first end along the axis. The actuator device body is configured to allow the actuator rod to move along the axis inside the actuator device body, and having has a first inlet flange configured to allow a third fluid to enter a space between the actuator device body and the actuator rod, and a first outlet flange configured to allow the third fluid to exit the actuator device body. The third fluid has a pressure larger than a pressure of the first fluid, and the first outlet flange is closer to the first end of the actuator rod than the first inlet flange.

According to another exemplary embodiment, a method of sealing a compressor fluid at a first end of an actuation bar and an environment at a second end of the actuation bar, the second end being opposite to the first end, and the actuation bar being configured to move along an axis, inside an actuator device body is provided. The method includes providing a first flow of compressor fluid routed from an output of the compressor in a space between the actuator device body and the actuator rod, via a first inlet flange of the actuator body and a first outlet flange of the actuator body, (1) the compressor fluid in the first flow having a pressure larger than a pressure of the compressor fluid at a first end of an actuation bar, and (2) the first outlet flange being closer to the first end of the actuator rod than the first inlet flange. The method further includes providing a second flow of neutral fluid in the space between the actuator device body and the actuator rod, via a second inlet flange of the actuator body and a second outlet flange of the actuator body, (3) the first inlet flange and the first outlet flange being closer to the first end than the second inlet flange and the second outlet flange, and (4) the second inlet flange being closer to the second end of the actuation bar than the second outlet flange.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION OF THE EXEMPLARY EMBODIMENTS OF THE INVENTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of compressors having inlet vanes that are modified by applying a force via an actuator device. However, the embodiments to be discussed next are not limited to these compressors, but may be applied to other systems that require to isolate an environment at one end of an actuator rod thereof from an environment at another end of the actuation rod.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

In actuator devices according to various embodiments, the mechanical seals with springs are replaced by dynamical sealing using one or more flows of fluid circulating between an actuator rod and an actuator body. At least one of the flows of fluid may heat the actuator rod preventing the formation of ice.

Figure 1:
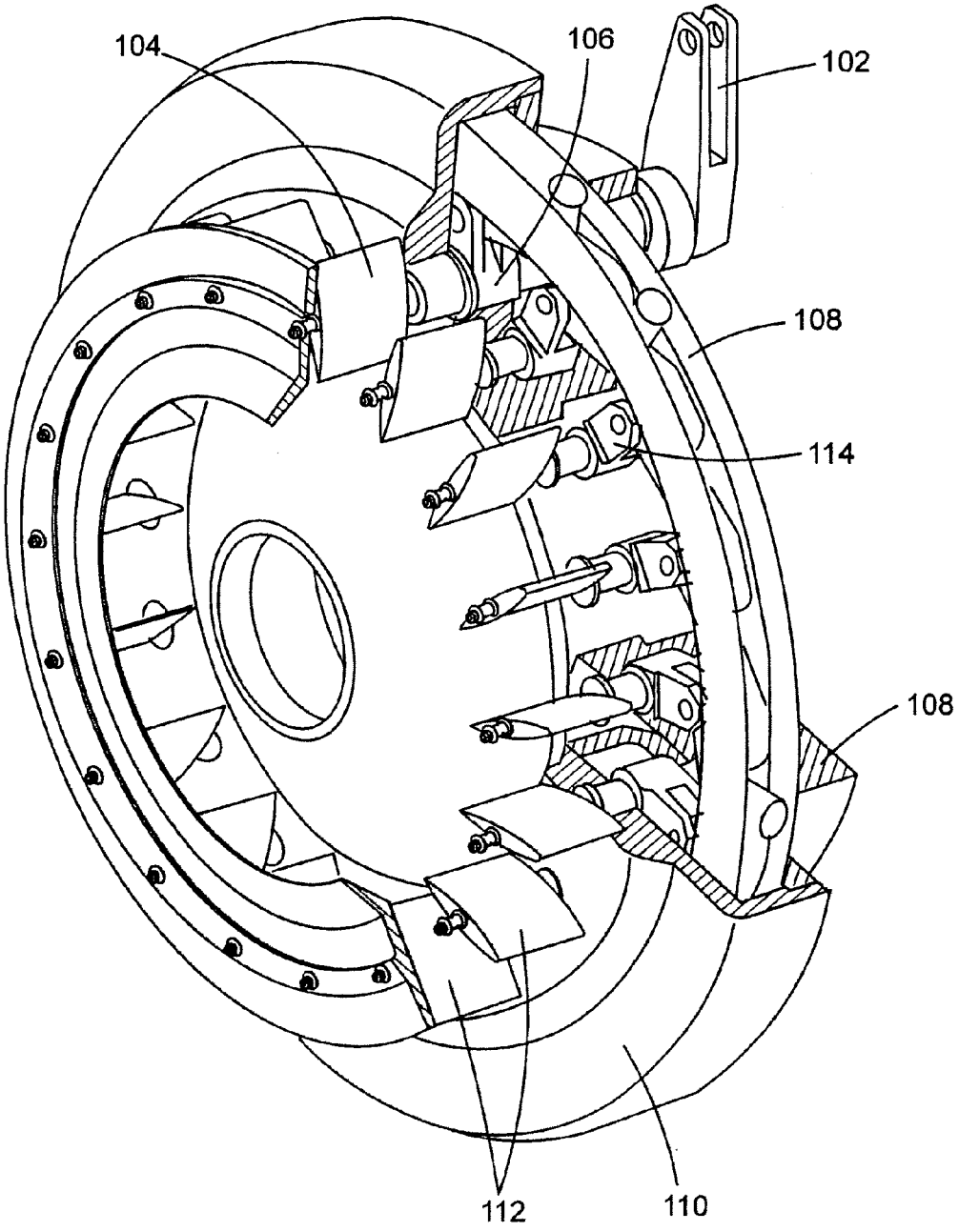
FIG. 1 is a schematic diagram of an IVG system.
Figure 2:
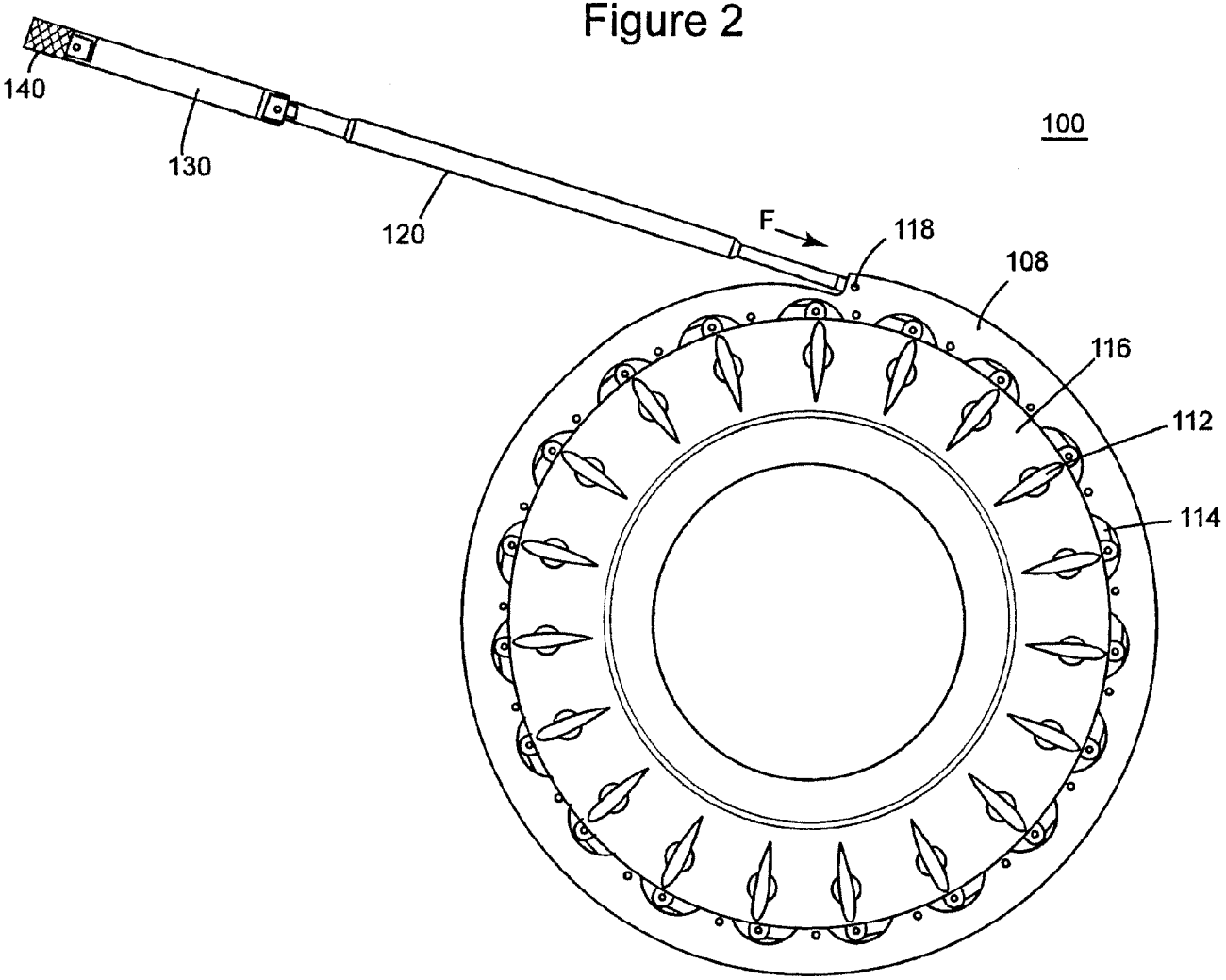
FIG. 2 is an illustration of an actuator device operating an IVG system.
Figure 3:
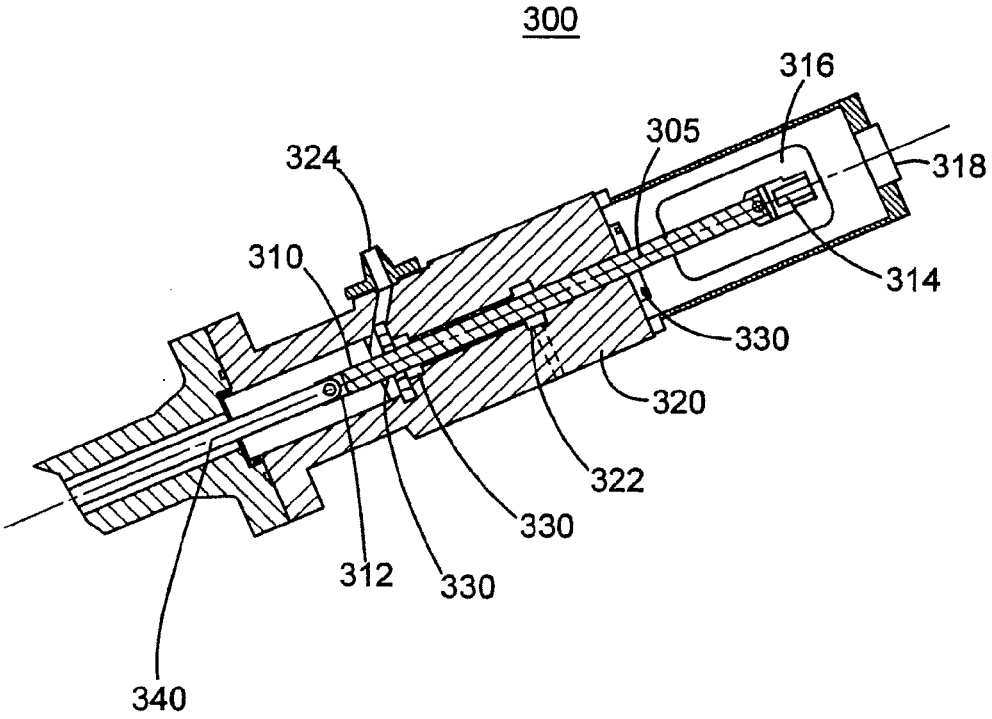
FIG. 3 is a schematic diagram of an actuator device according to an exemplary embodiment.

FIG. 3 illustrates an exemplary embodiment of an actuator device 300 that is configured to apply a force along an axis 305. The actuator device 300 may be used to change the orientation of one or more vanes. The actuator device 300 includes an actuator rod 310 configured to transfer a force along the axis 305. A first end 312 of the actuator rod 310 is surrounded by a first fluid, for example, natural gas entering a compressor.

The actuator rod 310 is mounted to move through an actuator device body 320. In other words, the actuator device body 320 is configured to allow the actuator rod 310 to move along the axis 305 inside the actuator device body 320. A second end 314 of the actuator rod 310 (which second end is opposite to the first end 312 along the axis 305) may be exposed to a second fluid that may be confined inside a cavity 316 of the actuator device body 320. Control electronics 318 may be mounted on the actuator device body 320 to be exposed with the second fluid. The term control electronics may stand for an actuator and/or an actuator motor. The invention is not limited by the device(s) collectively named control electronics exposed to the second fluid kept isolated from the corrosive first fluid.

The second fluid may be air or other fluid that does not have a negative effect on the electronics 318. However, the natural gas that may be compressed in a compressor is usually corrosive and typically leads to rapid degradation of the electronics. Therefore, the actuator device body 320 and the actuator rod 310 are configured and operated to prevent the first fluid (e.g., natural gas) from mixing with the second fluid (e.g., air).

The actuator body 320 is therefore configured to allow a third fluid to flow inside the actuator body, in a space between the actuator rod 310 and the actuator body 320. In order to allow the third fluid to enter this space, the actuator device body 320 has a first inlet flange 322. In order to allow the third fluid to exit the actuator device body, the actuator device body 320 has a first outlet flange 324. Thus, the third fluid flows from the first inlet flange 322 to the first outlet flange 324 parallel to the axis 305 and between the actuator rod 310 and the device body 320. The outlet flange 324 may be closer to the first end 312 of the actuator rod 310 than the first inlet flange 322. The third fluid may have a pressure larger than a pressure of the first fluid and/or substantially the same composition as the first fluid. For example, the third fluid may be compressed first fluid (i.e., gas) recirculated from an outlet of the compressor.

The third fluid may have a temperature different from a temperature of the first fluid. To control the temperature of the third fluid, a heat exchanger or similar known devices may be used. Thereby, the actuator rod 310, which is made of a good heat conductor (e.g., metal or metallic alloy), may be heated due to the third fluid so that condensation and ice do not occur.

A number of mechanical seals 330 may be present at various locations but the present inventive concept is not limited by the presence of other seals. Between the actuator 310 rod and the one or more vanes moved due to a force generated along the axis 305 in the actuator device 300, it may be a connecting rod 340, but the present inventive concept is not limited by the presence of such a connecting rod.

Figure 4:
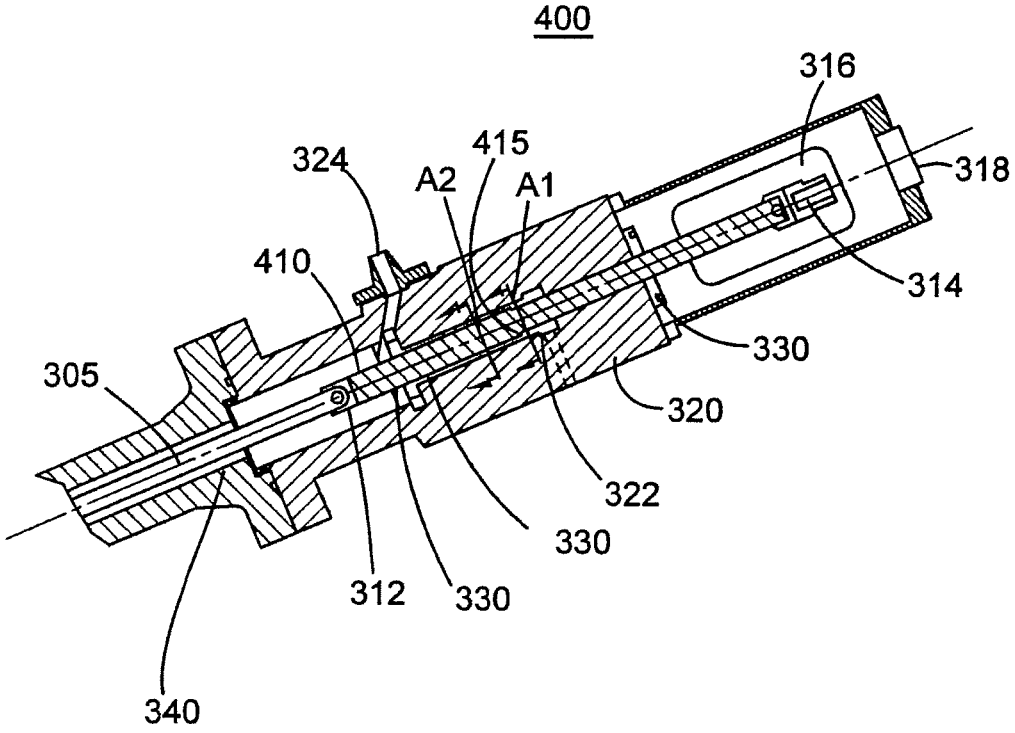
FIG. 4 is a schematic diagram of an actuator device according to another exemplary embodiment.

The third fluid flow may also be used to develop a force along the axis. For example, as illustrated in FIG. 4, an actuator device 400 according to another exemplary embodiment includes the actuator rod 410 configured to have a step 415 located between a position of the sealing inlet flange 322 and a position of the sealing outlet flange 324 along the axis 305. In other words, a first area A1 of the actuator rod 410, perpendicular to the axis 305, between the position of the sealing inlet flange and the step 415 is smaller than a second area A2 of the actuator rod 410, perpendicular to the axis, between the step 415 and the position of the sealing outlet flange 324. This change of cross-sectional area (perpendicular to a direction in which the third fluid flows, i.e., parallel to axis 305), makes the flow of the third fluid not only to seal the rod but also to generate a force in the flowing direction, thus contributing to the overall force of the actuator device 400. The step 415 has also a balancing effect as the fluid from the compressor acts on the rod 410 in one direction and the third fluid acts on the rod 410 in the opposite direction.

Figure 5:
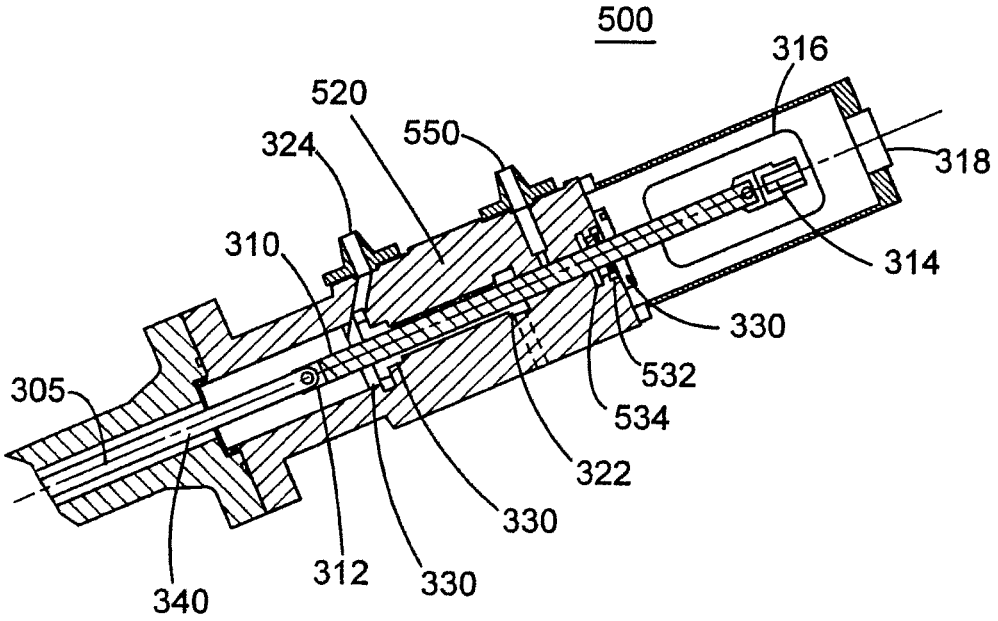
FIG. 5 is a schematic diagram of an actuator device according to another exemplary embodiment.

In another exemplary embodiment illustrated in FIG. 5, an actuator device 500 has an actuator device body 520 configured to allow another fluid to flow in the space between the actuator device body 520 and the actuator rod 310. The actuator device body 520 has a second inlet flange 532 configured to allow a neutral fluid to enter a space in-between the actuator device body 520 and the actuator rod 310, and a second outlet flange 534 configured to allow the neutral fluid to exit the actuator device body 520. The first inlet flange 322 and the first outlet flange 324 are closer to the first end 312 of the actuation rod 310 than the second inlet flange 532 and the second outlet flange 534. Also, the second inlet flange 532 is closer to the second end 314 of the actuation rod 310 than the second outlet flange 534. The neutral fluid may be mostly nitrogen ($N_2$), for example, the neutral fluid may contain 70% nitrogen.

When a pressure of the neutral fluid entering the space is larger than a pressure of the fluid entering the first inlet flange 322, it may further prevent the fluid from 322 to advance toward the closed cavity 316 where the electronics 318 is installed. Thus, the sealing around the actuator rod 310 is further enhanced. Of course, traditional seals 330 may also be provided closer to the end 314 of the rod 310 for further sealing.

Further, the actuator device body may include a vent 550 located between the first inlet flange 322 and the second outlet flange 534 along the axis 305, and configured to allow the neutral fluid and/or the third fluid to exit the actuator device body 520.

Figure 6:
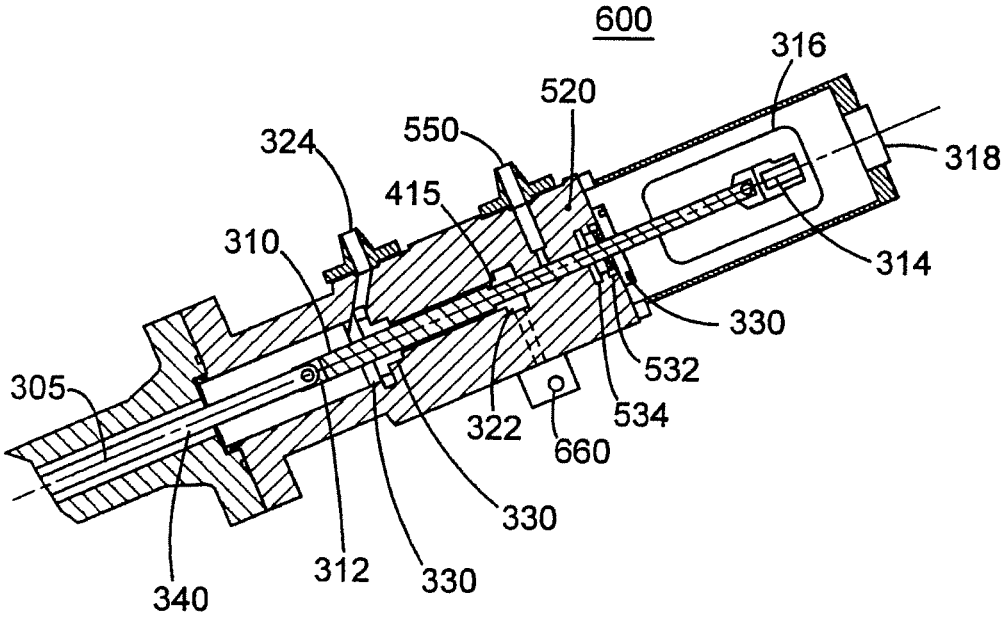
FIG. 6 is a schematic diagram of an actuator device according to another exemplary embodiment.

FIG. 6, is an embodiment of an actuator device 600 including plural of the features described above (the same reference numbers in FIGS. 3-6 identify the same or similar elements). Additionally, the actuator device 600 (or any of the actuators 300, 400, 500) may include a third fluid temperature regulator 660 configured to change a current temperature of the third fluid before entering the first inlet flange 322. The third fluid may be heated or cooled depending on the specific application/usage of the actuator device.

Figure 7:
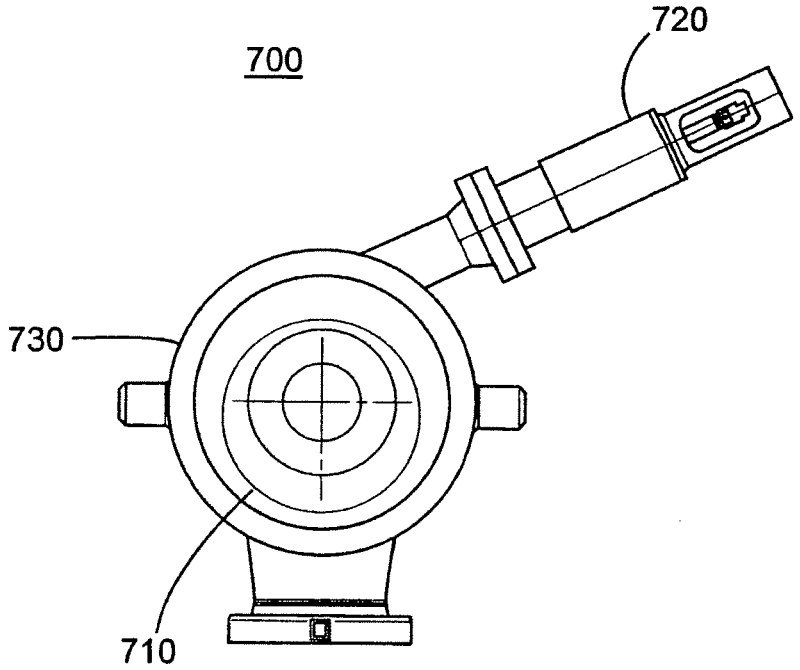
FIG. 7 is a schematic diagram of an actuator device operating in IGV vanes of a compressor according to another exemplary embodiment.

In an overall view illustrated in FIG. 7, compressor 700 has one or more vanes 710 configured to determine at least one of a direction and an amount of a first fluid passing through the compressor, and an actuator device 720. The actuator device 720, which may be any of the devices 300, 400, 500, 600 described above, is configured to apply a force to the one or more vanes 710. The compressor 700 has a compressor 730 body configured to receive the first fluid after passing through the one or more vanes, to compress the first fluid, and then to output the compressed first fluid. The third fluid may be a portion of the compressed first fluid.

Figure 8:
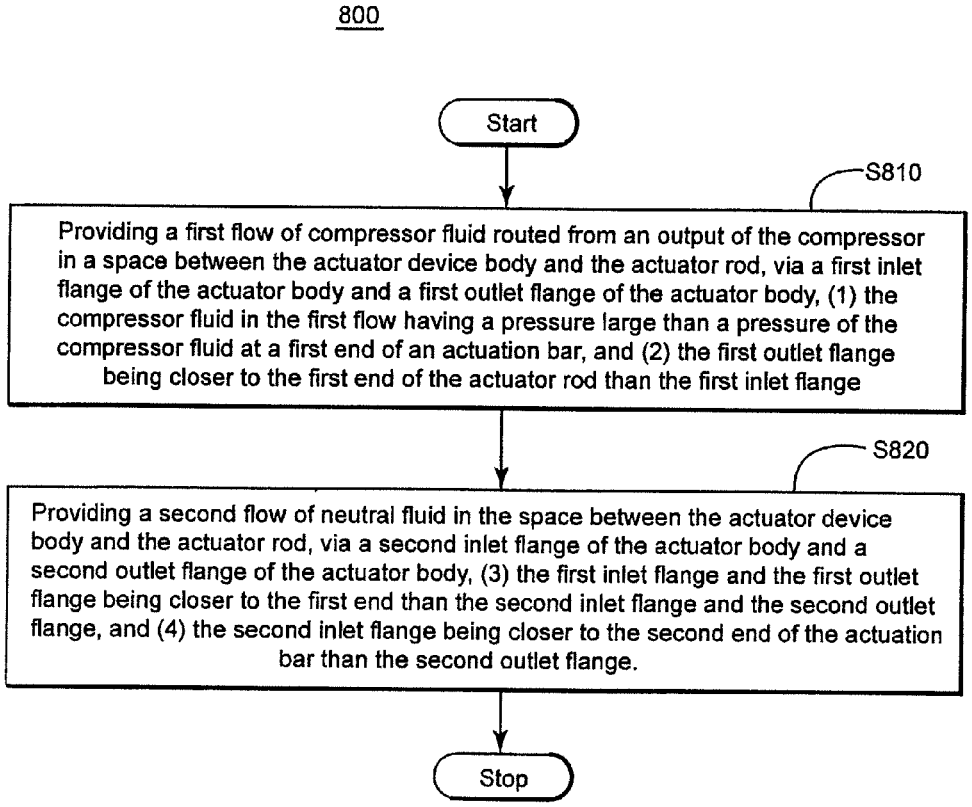
FIG. 8 is a flow chart of a method of sealing a compressor fluid at a first end of an actuation bar from an environment at a second end of the actuation bar in a compressor, the second end being opposite to the first end, and the actuation bar being configured to move along an axis according to an exemplary embodiment.

Some of the embodiments described about may execute a method 800 of sealing a compressor fluid at a first end of an actuator rod and an environment at a second end of the actuator rod, the second end being opposite to the first end, and the actuator bar being configured to move along an axis, inside an actuator device body. The method 800 illustrated in FIG. 8 includes providing a first flow of compressor fluid routed from an output of the compressor in a space between the actuator device body and the actuator rod, via a first inlet flange of the actuator body and a first outlet flange of the actuator body, (1) the compressor fluid in the first flow having a pressure larger than a pressure of the compressor fluid at a first end of an actuation bar, and (2) the first outlet flange being closer to the first end of the actuator rod than the first inlet flange, at 5810.

The method 800, further includes providing a second flow of neutral fluid in the space between the actuator device body and the actuator rod, via a second inlet flange of the actuator body and a second outlet flange of the actuator body, (3) the first inlet flange and the first outlet flange being closer to the first end than the second inlet flange and the second outlet flange, and (4) the second inlet flange being closer to the second end of the actuation bar than the second outlet flange, at S820.

The disclosed exemplary embodiments provide devices and methods for sealing, preventing icing and balancing an actuator of an IGV of a turbo-machine. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. An actuator device useable to change an orientation of one or more vanes, the actuator device comprising:

an actuator rod configured to transfer a force along an axis thereof, and comprising a first end exposed to a first fluid, and a second end exposed to a second fluid, the second end being opposite to the first end along the axis; and an actuator device body configured to allow the actuator rod to move along the axis inside the actuator device body, and comprising a first inlet flange configured to allow a third fluid to enter a space between the actuator device body and the actuator rod, a first outlet flange configured to allow the third fluid to exit the actuator device body, and a vent configured to allow at least one of a neutral fluid and the third fluid to exit the actuator device body, wherein the vent is located between the first inlet flange and a second outlet flange along the axis, and wherein the third fluid has a pressure larger than a pressure of the first fluid, and the first outlet flange is closer to the first end of the actuator rod than the first inlet flange.

2. The actuator device of claim 1, wherein the third fluid has substantially the same composition as the first fluid and the third fluid has a temperature different from a temperature of the first fluid.

3. The actuator device of claim 1, wherein the actuator rod further comprises a step located between a position of the first inlet flange and a position of a first outlet flange along the axis, wherein a first area of the actuator rod perpendicular to the axis, between the position of the first inlet flange and a location of the step is smaller than a second area of the actuator rod perpendicular to the axis, between the location of the step and the position of the first outlet flange.

4. The actuator device of claim 1, wherein the actuator device body further comprises:

a second inlet flange configured to allow neutral fluid to enter a space in-between the actuator device body and the actuator rod; and second outlet flange configured to allow the neutral fluid to exit the actuator device body, wherein the first inlet flange and the first outlet flange are closer to the first end than the second inlet flange and the second outlet flange.

5. The actuator device of claim 1, wherein the neutral fluid comprises about 70% nitrogen.

6. The actuator device of claim 1, wherein the actuator device body further comprises a closed cavity in which the second fluid is confined, and a pressure of a neutral fluid entering the space is larger than a pressure of the second fluid.

7. The actuator device of claim 1, further comprising:

a third fluid temperature regulator configured to change a current temperature of the third fluid before entering the first inlet flange.

8. A compressor, comprising:

one or more vanes configured to determine at least one of a direction and an amount of a first fluid passing through the compressor; and an actuator device configured to apply a force to the one or more vanes, the actuating device comprising:

an actuator rod configured to transfer a force along an axis thereof, and comprising a first end configured to be exposed the first fluid, and a second end configured to be exposed to a second fluid, the second end being opposite to the first end along the axis; and an actuator device body configured to allow the actuator rod to move along the axis inside the actuator device body, and comprising a first inlet flange configured to allow a third fluid to enter a space in-between the actuator device body and the actuator rod, a first outlet flange configured to allow the third fluid to exit the actuator device body, and a vent configured to allow at least one of a neutral fluid and the third fluid to exit the actuator device body, wherein the vent is located between the first inlet flange and a second outlet flange along the axis, and wherein the third fluid has a pressure larger than a pressure of the first fluid, and the first outlet flange is closer to the first end of the actuator rod than the first inlet flange.

9. The compressor of claim 8, wherein the third fluid has substantially the same composition as the first fluid and the third fluid has a temperature different from a temperature of the first fluid.

10. The compressor of claim 8, wherein the actuator rod further comprises a step located between a position of the first inlet flange and a position of a first outlet flange along the axis, wherein a first area of the actuator rod perpendicular to the axis, between the position of the first inlet flange and a location of the step is smaller than a second area of the actuator rod perpendicular to the axis, between the location of the step and the position of the first outlet flange.

11. The compressor of claim 8, wherein the actuator device body further comprises:

a second inlet flange configured to allow neutral fluid to enter a space in-between the actuator device body and the actuator rod; and second outlet flange configured to allow the neutral fluid to exit the actuator device body, wherein the first inlet flange and the first outlet flange are closer to the first end than the second inlet flange and the second outlet flange.

12. The compressor of claim 8, wherein the neutral fluid comprises about 70% nitrogen.

13. The compressor of claim 8, wherein the actuator device body further comprises a closed cavity in which the second fluid is confined, and a pressure of a neutral fluid entering the space is larger than a pressure of the second fluid.

14. The compressor of claim 8, further comprising:

a third fluid temperature regulator configured to change a current temperature of the third fluid before entering the first inlet flange.

15. A method of sealing a compressor fluid at a first end of an actuation bar and an environment at a second end of the actuation bar, the second end being opposite to the first end, and the actuation bar being configured to move along an axis, inside an actuator device body, the method comprising:

providing a first flow of compressor fluid routed from an output of the compressor in a space between the actuator device body and an actuator rod, via a first inlet flange of the actuator body and a first outlet flange of the actuator body, wherein the compressor fluid in the first flow has a pressure larger than a pressure of the compressor fluid at the first end of the actuation bar, and the first outlet flange is closer to the first end of the actuator rod than the first inlet flange; and providing a second flow of neutral fluid in the space between the actuator device body and the actuator rod, via a second inlet flange of the actuator body and a second outlet flange of the actuator body, wherein the first inlet flange and the first outlet flange are closer to the first end than the second inlet flange and the second outlet flange, and the second inlet flange is closer to the second end of the actuation bar than the second outlet flange.

16. The method of claim 15, further comprising heating or cooling the compressor fluid before providing the flow of the compressor fluid in the space between the actuator body and the actuator rod.

17. The method of claim 15, further comprising allowing at least one of the first flow of the compressed fluid and the second flow of the neutral fluid to exit the actuator device body via a vent, wherein the vent is located between the first inlet flange and the second outlet flange along the axis.

18. The method of claim 15, wherein providing the neutral fluid comprises injecting the second flow of the neutral fluid against a step in the actuator device body to generate a force along a direction that is opposite to a direction in which other force is generated by a flow of a first fluid at one end of the actuator device body, wherein the step is located between a position of the first inlet flange and a position of a first outlet flange along the axis.

* * * * *